United States Patent [19]

Kobelt

[11] 4,280,371

[45] Jul. 28, 1981

[54] CONTROL LEVER ASSEMBLY

[76] Inventor: Jacob Kobelt, 6110 Oak St., Vancouver, B. C., Canada, V6M 2W2

[21] Appl. No.: 9,695

[22] Filed: Feb. 5, 1979

[51] Int. Cl.[3] ..... G05G 11/00

[52] U.S. Cl. ..... 74/480 B; 74/491; 192/0.096

[58] Field of Search ..... 74/491, 480 B, 506; 192/0.096, 0.098; 403/119

[56] References Cited

U.S. PATENT DOCUMENTS

| | | | |
|---|---|---|---|
| 2,771,168 | 11/1956 | Panish | 192/0.096 |
| 4,034,835 | 7/1977 | Baba | 192/0.098 |
| 4,089,397 | 5/1978 | Baba | 192/0.096 |
| 4,106,604 | 8/1978 | Baba | 192/0.098 |

*Primary Examiner*—Dave W. Arola

*Attorney, Agent, or Firm*—Carver & Co.

[57] ABSTRACT

Control lever assembly for cable operated apparatus in which ends of cable cores are connected to lever with simple structure eliminating clevis and locked pin to provide compact, easy-to-service anchors. Independently adjustable drag or friction device reduces accidental creep of lever, and/or indexing device provides resilient positive location of lever. Lever is journalled for swinging and mounts a rotatable member having a first anchor structure and a support member secured to the rotatable member and having a second anchor structure spaced from the first anchor. A cable fitting has journals and is secured to the end of the cable and fits between the support member and rotatable member to anchor the cable thereto. Axle pin passing through the fitting journals fitting in aligned recesses of rotatable member and support member.

12 Claims, 5 Drawing Figures

CONTROL LEVER ASSEMBLY

BACKGROUND OF THE INVENTION

1. Field of the Invention

The invention relates to a control lever assembly, in particular to a twin lever control assembly for push-pull cable operated devices as used for controlling the throttle and clutch of a marine power unit.

2. Prior Art

Twin lever controls having clutch and throttle levers have been used for many years in marine vessels. With such controls an operator can control the clutch and throttle independently to enable safe and effective operation of the marine engine driving the propeller shaft through a gear box. The throttle lever controls the engine speed and can be positioned at any position between idle and full throttle so as to permit fine adjustment of engine speed. Commonly, a friction or drag device is used to prevent the lever accidentally creeping due to vibration that is commonly present on marine vessels. The clutch lever has three basic positions, namely ahead and astern and an intermediate position, neutral. Commonly, for safety, an indexing device is provided to locate the clutch lever in the neutral position so as to prevent accidental engagement of the gears. The two levers are mounted in a common housing on opposite sides thereof, and each lever is connected to one or two control cables, two cables allowing operation in series or in parallel rigging. The cables used are push-pull type control cables in which a core slides in a flexible sleeve which permits routing of the cable as desired, and provides positive action in tension or compression as the lever is swung in either direction.

The control levers are fitted at one or more control stations about the vessel and commonly there is a shortage of space at such stations and thus a relatively compact lever assembly is an advantage. Some prior art lever assemblies are relatively bulky and, when installed in the vessel, are difficult to connect to cables and also to service, and some of this difficulty results from the relatively large size of the control unit fitted in a small space. A common limitation to the size of the unit relates to the structure for anchoring ends of the control cables to the lever assembly. Commonly, an end of each cable core carries a clevis which is pinned to a bellcrank or other rotatable member controlled by the lever. The clevis is connected to the bellcrank by an axle pin which is commonly a bolt secured with locked nuts, cotter pin locking means or equivalents. For connection of the clevis to the lever, lateral clearance in the housing for insertion of the pin or bolt through the clevis is required. When two levers are fitted in the same housing a considerable amount of space is required for this connection otherwise servicing becomes very cumbersome. In the past, to reduce the space required, the design of such control levers has been compromised in order to take up less space, which increases the difficulty of servicing.

Also, the friction or drag means to prevent creeping of the throttle lever, and the indexing means to locate with the clutch lever in neutral have been particularly difficult to install in the space available and in some types have been incorporated into the same structure such that an adjustment of the throttle drag also tended to effect drag of the clutch lever and this detracted from "feel" of the clutch for locating neutral.

SUMMARY OF THE INVENTION

The invention reduces difficulties and disadvantages of the prior art by providing a relatively compact single or twin lever control unit in which ends of the cables connected to the control lever assembly are releasably anchored by a relatively compact fitting which eliminates the need for the prior art clevis and associated pin or bolts, etc. This permits design of a more compact unit which also facilitates servicing. Furthermore, the drag or friction adjustment for the throttle lever is independent of the indexing means adjustment for the clutch lever which provides a unit which can be easily adjusted according to personal preference of the operator.

A control assembly according to the invention is for use with a cable operated apparatus in which the lever assembly is connected to an end of the cable extending from the apparatus. The control lever assembly has a lever journalled for swinging about an axis of rotation and is characterized by a rotatable member, a support member, a cable fitting and a journalling means. The rotatable member cooperates with the lever to rotate about the axis of rotation as the lever is swung thereabout and the support member is securable to the rotatable member so as to rotate therewith and to provide a clearance between the members. At least one of the members has a recess. The cable fitting is adapted for securing to the end of the cable and for fitting in the clearance between the support member and the rotatable member. The journalling means cooperates with the cable fitting, with the recess of the one member, and with the remaining member to journal the fitting between the members.

A detailed disclosure following, relating to the drawings, describes a preferred embodiment of the invention which is capable of expression in structure other than that particularly described and illustrated.

DETAILED DISCLOSURE

Figure 1:
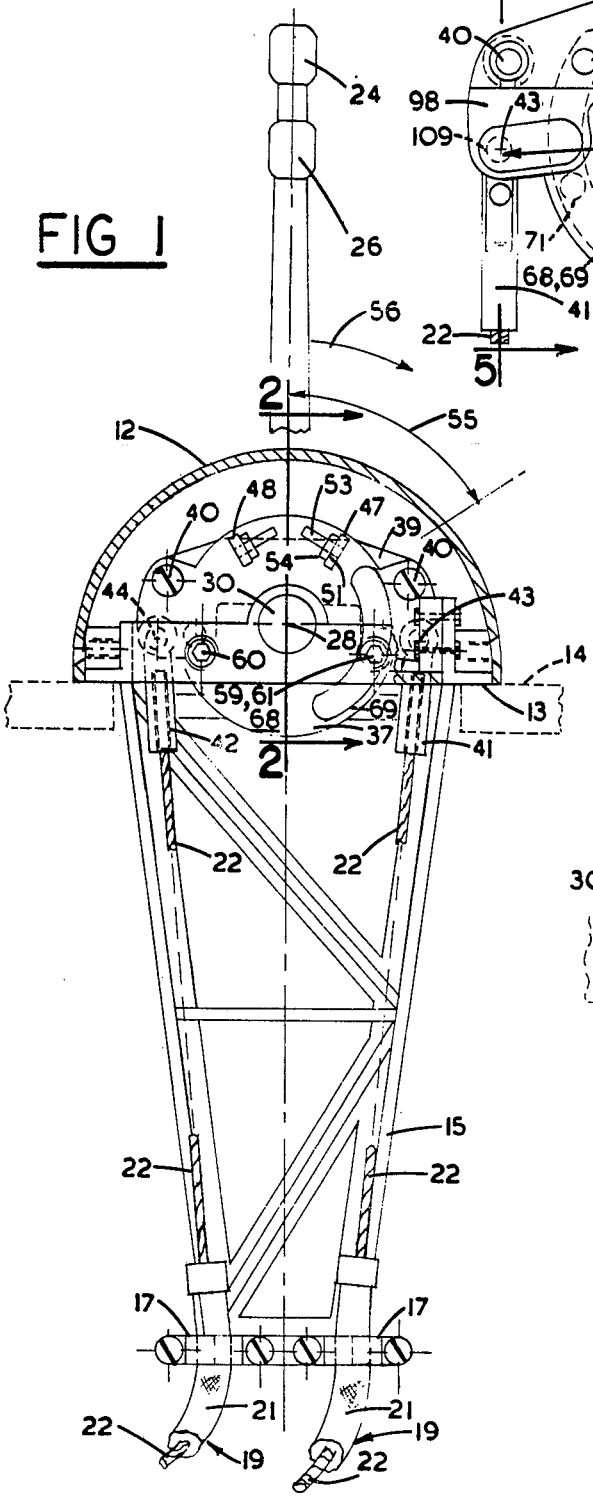
FIG. 1 is a simplified fragmented side elevation, shown partially in section, of a control lever assembly according to the invention as used in a twin lever marine control.
Figure 2:
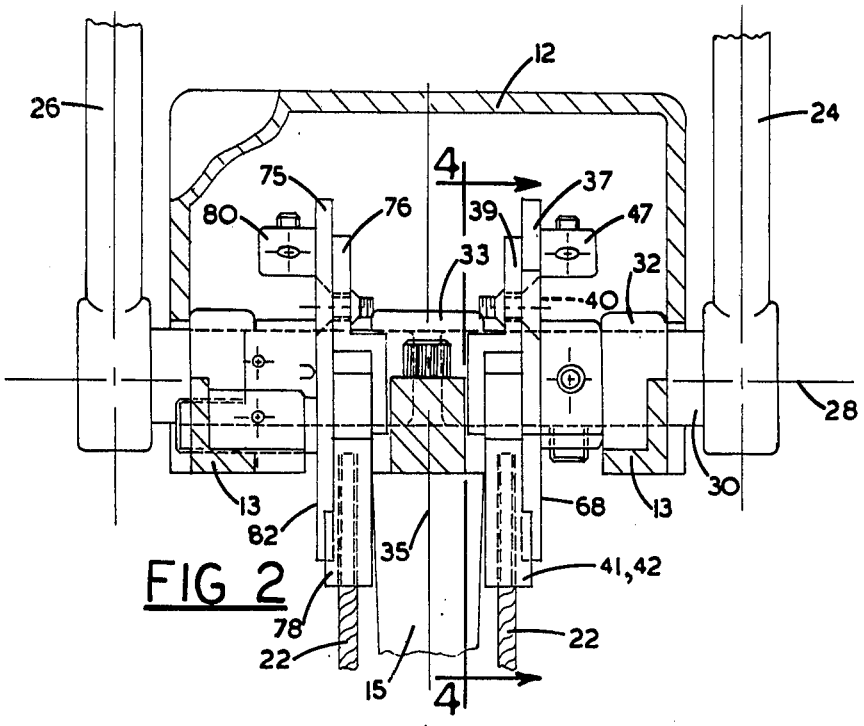
FIG. 2 is a simplified fragmented section on line 2—2 of FIG. 1, at an enlarged scale.
Figure 3:
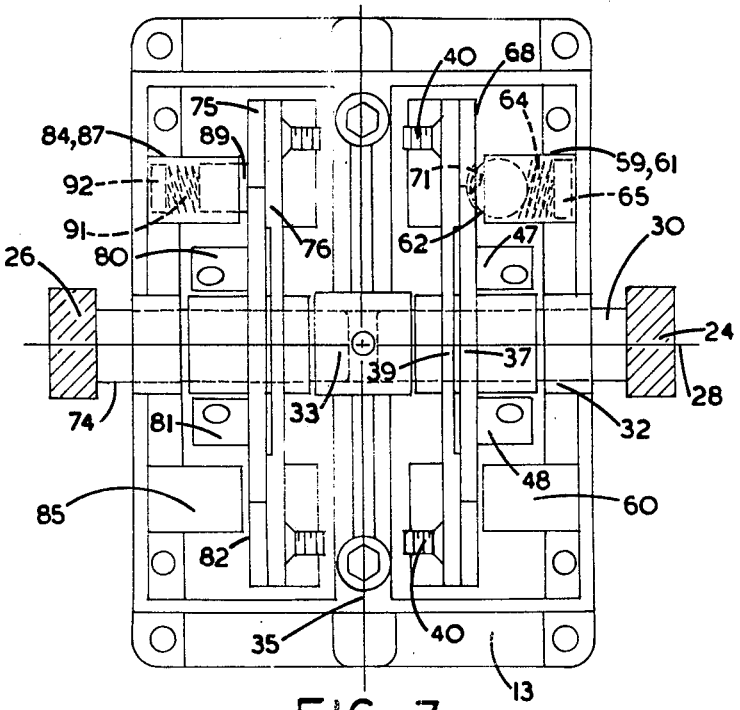
FIG. 3 is a simplified fragmented top plan of the apparatus, some portions being removed or sectioned for clarity.

FIGS. 1 through 3

A control lever assembly 10 according to the invention has a semi-cylindrical cover plate 12 having a pair of undesignated semi-circular end plates, the cover plate being secured to a rectangular mounting frame 13 normally secured to a horizontal surface or table 14 at a control station of a marine vessel. A cable anchoring frame 15 extends downwardly from the frame 13 and carries cable clamps 17 adapted to secure a plurality of cables 19 connected to the control lever assembly. Each cable 19 has an outer sheath 21 and a flexible but longitudinally inelastic core 22 which is adapted to transfer compressive or tensile forces from the control assembly longitudinally of the cable in either direction. A suitable cable is marketed under the trade mark "Controlex", a trade mark of the Controlex Corporation of New York, United States of America, but other cables capable of transmitting force in either direction can be substituted.

The assembly 10 has a clutch lever 24 and a throttle lever 26 for operation of a clutch and throttle respectively of a marine power unit, not shown. Clearly, other cable operated devices could be substituted to be controlled by this type of control assembly. The control levers are journalled for swinging about an axis of rotation 28 and each lever cooperates with adjacent ends of two cables for use in series or parallel relationship for multiple station arrangements, or with one cable each for single station arrangement. The levers cooperate with the cables in a generally similar manner and thus only the clutch lever 24 and associated structure will be described in detail.

Figure 4:
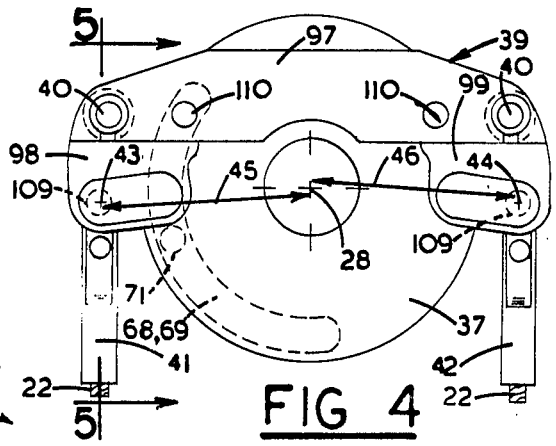
FIG. 4 is a simplified fragmented side elevation showing ends of control cables cooperating with a portion of the control assembly, as seen generally from line 4—4 of FIG. 2, some portions being omitted.

The lever 24 has an integral spindle 30 journalled in a pair of spaced journals, namely a journal 32 adjacent the cover plate 12 and a journal 33 adjacent and straddling a vertical central plane 35 of the cover plate. A cable plate 37 is secured non-rotatably to the spindle 30 so that rotation of the lever simultaneously rotates the cable plate. A pin retainer 39 is secured to the cable plate 37 by a pair of countersunk screws 40 and is spaced from the upper plate so as to receive cable end fittings 41 and 42 secured to respective ends of the cores 22 of the cables 19. The fittings 41 and 42 are journalled for rotation relative to the cable plate and pin retainer about respective pin axes 43 and 44. As best seen in FIG. 4, the axes 43 and 44 are spaced from the axis of rotation 28 by equal axis spacings 45 and 46 so that rotation of the lever 24 about the axis 28 pulls and pushes the cable cores 22 and thus actuates the devices and/or a similar control assembly at the opposite ends of the cables.

A pair of stop means 47 and 48 extend outwardly from the plate 37 and are generally similar and thus only the stop means 47 will be described. The means 47 has a bracket 51 which has a threaded opening carrying a short stud 53 having a locking nut 54. Rotation of the lever 24 through a sufficient angle 55 in direction of arrow 56 causes the stop means 47 to interfere with the frame 13. Clearly, adjustment of the stud 53 and lock nut 54 permits line adjustment of the angle through which the lever 24 can be swung before being limited by the stop means. The stop means 48 functions similarly to limit rotation of the lever in an opposite direction, and clearly other portions of the apparatus can be substituted to interfere with the stop means.

As best seen in FIG. 3, the mounting frame 13 carries a pair of housings 59 and 60 extending inwardly therefrom towards the cable plate 37. The housing 59 is an indexing housing of an indexing means 61 and has an indexing member 62 therein, the member 62 being a steel ball. In this particular application, the housing 60 is not used functionally and merely serves as an alternative location for the indexing means or for structure for other purposes, as will be described. A compression spring 64 is retained in the housing 59 between a set screw 65 and the indexing member 62 and thus the indexing member is forced outwardly against an outer face 68 of the plate 37. As best seen in FIGS. 1 and 3, the outer face 68 has an annular surface 69 swept by the indexing member 62 and has an indexing recess 71 therein, the recess being complementary to the member 62 and shown in broken outline. The indexing member is thus resiliently forced into contact with the annular surface so that the recess is engaged by the indexing member when mutually aligned, thus locating the rotatable member and lever. The spring urging the indexing member has sufficient resilience to permit disengagement from the indexing recess when sufficient force is applied to the lever. This is of considerable importance in a clutch lever because the clutch lever is arranged to be in the neutral position when the indexing means are engaged. An operator should be able to locate the neutral position easily, and the indexing member reduces chances of accidental shifting of the lever. The indexing means will also reduce chances of creeping of the lever from the neutral position as a result of vibration which is normally present at control stations.

Thus, in summary, it can be seen that the cable plate 37 has a surface of revolution, i.e. the surface 69, centered on the axis of rotation 28, the surface of revolution having a first indexing means, namely the indexing recess 71. The mounting frame 13 journals the lever 24 and plate 37 for rotation and has a second indexing means, namely the resiliently mounted indexing member 62, generally adjacent the surface of revolution. The second indexing means cooperates with the first indexing means so that when the indexing means are engaged the lever is located in the required neutral position. The second indexing means is disclosed as a spring urged member but other indexing means having sufficient resilience to permit disengagement upon application of sufficient force to the lever can be substituted.

With reference to the throttle lever 26, this structure is generally similar to the clutch lever 24 but differs from the clutch lever only in a different mode of controlling swinging of the lever. Thus the lever 26 is mounted for rotation about the axis 28 and has an integral spindle 74 journalled in the frame 13, and has a cable plate 75 mounted on the spindle and carrying a pin retainer 76. The spindle 24 has an inner end journalled in the central journal 33 adjacent the central plane 35 of the housing and thus both spindles are aligned but journalled for independent rotation. A pair of cable end fittings are similarly fitted between the pin retainer and cable plate to connect the cable to the throttle control of the power unit, one fitting 78 only being shown in FIG. 2. Similar stop means 80 and 81 extend from the plate similarly to the stop means 47 and 48 to limit swinging of the lever 26. The cable plate 75 similarly has an outer surface, which surface has a surface of revolution 82 centered on the axis of rotation 28.

The mounting frame 13 has another pair of spaced housings 84 and 85 disposed as mirror images to the housings 59 and 60 on an opposite side of the plane 35. In this instance, the housing 84 serves as a drag housing for mounting a friction or drag means 87 positioned adjacent the cable retainer plate, and the housing 84 is not used. The drag means 87 has a friction element 89, e.g. a plastic cylindrical plug urged into contact with a second surface of revolution 90 by a compression coil spring 91 fitted between the element 89 and a set screw 92. It can be seen that the friction element sweeps the second surface 90 and provides resistance to rotation of the lever to reduce the chances of the throttle lever accidentally creeping or rotating due to vibration.

Figure 5:
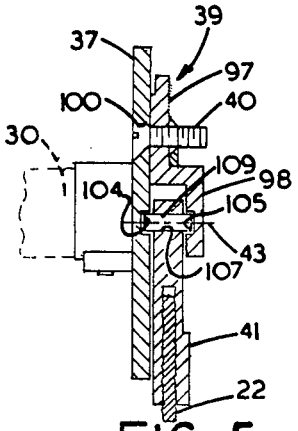
FIG. 5 is a simplified section on line 5—5 of FIG. 4.

FIGS. 4 and 5

The structural details of the cable plate 37 and the pin retainer 39 and securing the cable end fittings thereto will now be particularized. The end fittings 41 and 42 cooperate similarly and thus only the fitting 41 will be described.

The pin retainer 39 has a central portion 97 adapted to be secured adjacent to the cable plate and has a pair of outer portions 98 and 99 extending therefrom so as to be spaced axially from the support member and serving as bracket means. With reference to the outer portion 98, the cable plate 37 has a countersunk opening 100 accepting a countersunk-head of the screw 40 which has a threaded shank accepted in a threaded opening in a dimple of the retainer 39. The plate 37 and pin retainer 39 have cylindrical recesses 104 and 105 respectively which are aligned and concentric with the axis 43 and thus spaced at the radial spacing 45 from the axis of rotation 28. The end fitting 41 has a bore 107 disposed transversely to an adjacent end of the core 22 of the cable 19, the bore having a diameter generally equal to the diameters of the recesses. An axle pin 109 passes through the bore 107 of the fitting and has opposite ends received in the recesses 104 and 105 so as to journal the fitting to the cable plate. The bracket means are similar, i.e. the portions 98 and 99 each have a recess disposed oppositely to a corresponding adjacent recess in the cable plate 37 so as to provide a pair of aligned recesses to accept ends of the pin 109 to serve as anchor means to locate the end of the cable. Whilst the pin 109 is shown as a separate item from the fitting 41, clearly it could be integral therewith to function as an axle means cooperating with the fitting and adapted to be received in the recesses of the anchor means. Other equivalents can be substituted, such as an axle pin moulded integrally with either the cable plate or the pin retainer to receive the cable fitting thereon. Thus the support member is securable to the rotatable member to provide a clearance between the members to accept the fitting. Furthermore, at least one of the members has a recess and the axle pin 109 serves as a journalling means cooperating with the cable fitting and with the recess of the one member and with the remaining member to journal the fitting between the members. For strength, each screw 40 securing the plate and retainer together is closely adjacent and circumferentially aligned with the axle pin carrying load from the cables.

Thus it can be seen that the cable plate 37 is a plate-like rotatable member having a first anchor means, namely the cylindrical recess 104. The plate 37 extends generally normally to the spindle and cooperates with the lever to rotate about the axis of rotation as the lever is swung thereabouts. Similarly, the pin retainer 39 is a support member securable to the rotatable member and having a second anchor means, namely the cylindrical recess 105, spaced from the first anchor means of the rotatable member to cooperate therewith so as to anchor the fitting between the support member and the rotatable member. Whilst the first and second anchor means of the rotatable member and support member respectively are shown to be cylindrical recesses, conical recesses or other shapes complementary to the axle can be substituted. In any event, an axle pin extends between each pair of aligned oppositely disposed recesses, the pin anchoring the fitting at the end of each cable.

The plate 37 and retainer 39 are shown having a pair of recesses on each side of the axis of rotation 28, each pair being spaced at equal distances from the axis so as to provide a lever assembly having adjustable cable travel for a similar swing of the lever, that is the lever "ratio" is variable to suit different applications. Recesses provided on opposite sides of the axis 28 permits application of the device in series or parallel rigging and facilitates reversal of lever actuation. Complementary dowel and recess means 110 are provided on the pin retainer and the plate for additional location thereof.

OPERATION

The support frame 13 is secured to the control table at the control station and ends of the sheaths 21 of the cables are secured to the cable clamps 17 with ends of the corresponding cores 22 secured to the cable end fittings 41, 42, 78, etc. The cable end fittings can be easily secured to the cable plates 37 and 75 by unscrewing the countersunk-headed screws until the pin retainers 39 and 76 are loosened and spaced sufficiently from the respective cable plates to permit the cable end fitting with a respective axle pin therein to pass therebetween. Preferably the screws are sufficiently long to permit this without disengagement from the pin retainers. Ends of the pins are received in the aligned recesses and the screws are then tightened, thus permanently anchoring the cable fitting between the cable plates and pin retainers. The stop means 47 and 48 and equivalents on the plate 75 are easily adjusted to provide the desired angular sweep of the lever between its two extreme positions.

Thus, in summary, when the lever assembly controls a twin cable operated device as in a typical marine power plate installation, the lever assembly has first and second levers, corresponding first and second spindles and first and second rotatable members, each lever cooperating with its respective spindle and rotatable member for independent rotation about the axis of rotation. The first rotatable member, e.g. for the clutch control, has a surface of revolution and an indexing means cooperating with this surface to resiliently position the clutch lever in neutral. The second rotatable member, e.g. for the throttle, has a second surface of revolution and drag or friction means sweeping the second surface to resist rotation of the second rotatable member to prevent essentially creep of the second lever due to vibration.

I claim:

1. A control lever assembly for a cable operated apparatus in which the lever assembly is connected to an end of a cable extending from the apparatus, the control lever assembly having a lever journalled for swinging about an axis of rotation and being characterized by:

(a) a rotatable member cooperating with the lever to rotate about the axis of rotation as the lever is swung thereabouts and a support member securable to the rotatable member so as to rotate therewith and to provide a clearance between the members, at least one of the members having a recess, (b) a cable fitting fitted in the clearance between the members and adapted for securing to the end of the cable, (c) journalling means cooperating with the cable fitting, with the recess of the one member, and with the remaining member to journal the fitting between the members.

2. A control lever assembly as claimed in claim 1 in which:

(a) the rotatable member and the support member both have recesses, the recesses being aligned with each other.

3. A control lever assembly as claimed in claim 2 in which:

(a) the recesses are generally cylindrical.

4. A control lever assembly as claimed in claim 2 or 3 in which the journalling means of the fitting is characterized by:

(a) axle means cooperating with the fitting and received in the recesses of the rotatable and support members.

5. A control lever assembly as claimed in claim 2 or 3 in which the journalling means of the fitting is characterized by:

(a) the fitting having a bore disposed transversely to an adjacent end of the cable, (b) an axle pin passing through the bore of the fitting and having opposite ends received in the recesses of the rotatable and support members.

6. A control lever assembly as claimed in claim 1 further characterized by:

(a) the rotatable member having a surface of revolution centered on the axis of rotation, (b) a mounting frame mounting the lever and rotatable member for rotation and having a drag means positioned adjacent the rotatable member, the drag means having a friction element urged into contact with the surface of revolution so as to provide resistance to rotation of the lever.

7. A control lever assembly as claimed in claim 1 further characterized by:

(a) the rotatable means having a surface of revolution centered on the axis of rotation, the surface of revolution having a first indexing means, (b) a mounting frame journalling the lever and rotatable member for rotation and having a second indexing means generally adjacent the surface of revolution, the second indexing means cooperating with the first indexing means so that when the indexing means are engaged the lever is located in a required position, the indexing means having sufficient resilience to permit disengagement upon application of sufficient force to the lever.

8. A control lever assembly as claimed in claim 1 further characterized by:

(a) a mounting frame and a spindle concentric with the axis of rotation, the mounting frame journalling the spindle therein, the spindle cooperating with the lever and rotatable means, (b) the rotatable member being plate-like and extending generally normally to the spindle and having the recess spaced at a radial distance from the axis of rotation, (c) the support member having a central portion adapted to be secured adjacent to the rotatable member, and an outer portion having bracket means extending therefrom so as to be spaced axially from recess of the support member, the bracket means having a recess disposed oppositely to the corresponding adjacent recess in the rotatable member so as to provide a pair of aligned recesses.

9. A control lever assembly as claimed in claim 8 further characterized by:

(a) said journalling means including an axle pin extending between the aligned oppositely disposed recesses, the pin anchoring the fitting at the end of the cable.

10. A control lever assembly as claimed in claim 8 further characterized by:

(a) the rotatable member having an annular surface, the annular surface having an indexing recess therein, (b) the mounting frame having an indexing housing having an indexing member therein, the indexing member being resiliently urged into contact with the annular surface so that the indexing recess is engaged by the indexing member when mutually aligned, the rotatable member and lever being then located by the indexing member, the indexing member having sufficient resilience to permit disengagement from the indexing recess when sufficient force is applied to the lever.

11. A control lever assembly as claimed in claim 10 in which the lever assembly controls a plurality of cable operated devices, the assembly being further characterized by:

(a) the lever assembly having first and second levers, corresponding first and second spindles and first and second rotatable members, each lever cooperating with its respective spindle and rotatable member for independent rotation about the axis of rotation, (b) the first rotatable member having the annular surface cooperating with the indexing means, (c) the second rotatable member having a second annular surface, (d) the mounting frame having a drag housing containing a friction means adapted to sweep the second annular surface to resist rotation of the second rotatable member.

12. A control lever assembly as claimed in claim 1 further including:

(a) adjustable stop means extending from the rotatable member and adapted to interfere with a portion of the apparatus to limit rotation of the lever.

* * * * *